US006666453B2

(12) United States Patent
Chambers

(10) Patent No.: US 6,666,453 B2
(45) Date of Patent: Dec. 23, 2003

(54) PUZZLE AND ELEMENTS FOR CREATING PUZZLES

(76) Inventor: Raymond M. Chambers, 6033 Liberty Fairfield Rd., Hamilton, OH (US) 45011

( * ) Notice: Subject to any disclaimer, the term of this patent is extended or adjusted under 35 U.S.C. 154(b) by 0 days.

(21) Appl. No.: 10/041,733

(22) Filed: Jan. 10, 2002

(65) Prior Publication Data

US 2003/0127795 A1 Jul. 10, 2003

(51) Int. Cl.[7] ..... A63F 9/08
(52) U.S. Cl. ..... 273/157 R; 273/156
(58) Field of Search ..... 273/157 R, 153, 273/156

(56) References Cited

U.S. PATENT DOCUMENTS

D169,482 S * 5/1953 Henke et al. ..... D21/478
2,900,190 A * 8/1959 Pestieau ..... 273/157 R
3,665,617 A 5/1972 Gilbert
D265,919 S 8/1982 Spiecker
4,428,732 A * 1/1984 Meyer ..... 434/160
4,699,602 A * 10/1987 Giorgi ..... 446/124
D298,149 S 10/1988 Hermans et al.
5,405,135 A * 4/1995 Embro ..... 273/160
5,544,882 A * 8/1996 Sarkar ..... 273/157 R
5,605,332 A * 2/1997 Harnett ..... 273/157 R
5,868,388 A * 2/1999 Wood et al. ..... 273/157 R

* cited by examiner

*Primary Examiner*—Kien T. Nguyen
(74) *Attorney, Agent, or Firm*—Browdy and Neimark, P.L.L.C.

(57) ABSTRACT

A puzzle or game is provided which is capable of multiple solutions. The puzzle pieces are all geometric shapes having only right angles. The puzzle pieces are assembled in a tray, which optionally includes a storage area.

10 Claims, 6 Drawing Sheets

| A | B | | C | | D |
|---|---|---|---|---|---|
| 1 | 3 | × | 3 | = | 9 |
| 2 | 4 | × | 4 | = | 16 |
| 3 | 4 | × | 4 | = | 16 |
| 4 | 3 | × | 4 | = | 12 |
| 5 | 3 | × | 4 | = | 12 |
| 6 | 3 | × | 4 | = | 12 |
| 7 | 2 | × | 6 | = | 12 |
| 8 | 2 | × | 6 | = | 12 |
| 9 | 2 | × | 6 | = | 12 |
| 10 | 2 | × | 6 | = | 12 |
| 11 | 2 | × | 6 | = | 12 |
| 12 | 1 | × | 7 | = | 7 |
| | 31 | | | | 144 |

SECTION A–A

PUZZLE AND ELEMENTS FOR CREATING PUZZLES

FIELD OF THE INVENTION

The present invention is directed to a puzzle comprising elements which can be assembled in various configurations to produce a plurality of puzzle designs.

BACKGROUND OF THE INVENTION

Geometric and mechanical puzzles and games have been used as a source of entertainment and mental challenge for many years. Such puzzles may appeal to both the intellect and the aesthetic senses of the solver. They typically consist of a plurality of pieces which, when properly manipulated, will interlock into an assembly to form one or more predetermined shapes or designs.

However, the number of techniques for assembling the pieces of a mechanical puzzle appears to be limited and, consequently, the discovery of new configurations intrigues both solvers and collectors. The allure, and therefore the inherent value, of a particular puzzle or game derives from, among other things, the degree of challenge it presents, its versatility, and various aesthetic considerations, such as symmetry.

SUMMARY OF THE INVENTION

It is an object of the present invention to overcome deficiencies in the prior art.

It is another object of the present invention to provide a puzzle or game which is capable of multiple solutions.

It is yet another object of the present invention to provide a puzzle which includes a tray and holder therefor, as well as a recess to store the remaining pieces of the unfinished puzzle.

It is a still further object of the present invention to provide a puzzle having solutions that produce a visually appealing design.

The present invention provides a puzzle made of a number of pieces, all of which have only right angles and straight sides. These pieces of varying configurations are assembled in a puzzle tray in different arrangements to produce different visually appealing designs.

The puzzle comprises a plurality of puzzle pieces of shapes defined only by right angles and made of a certain number of squares. Each piece may be made of a different color so that designs are produced when the puzzle is assembled. The pieces are assembled in a tray or base which may be divided into any number of squares. While the tray or base is preferably a square, it may assume any quadrilateral form made up of squares such that the puzzle pieces fit within the form. The larger the quadrilateral, the more variations there are in solving the puzzle to produce a visually pleasing design.

DETAILED DESCRIPTION OF THE INVENTION

Figure 1:
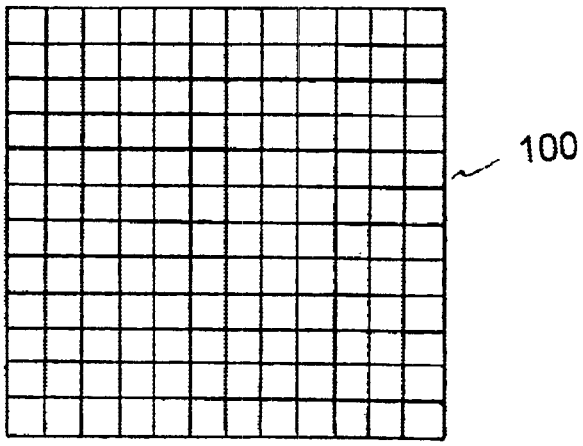
FIG. 1 shows the basic concept of the puzzle of the present invention.

FIG. 1 illustrates the basic concept of the puzzle according to the present invention. The puzzle comprises a square 100 divided, for purposes of illustration into 12 squares across and 12 squares down for a total of 144 squares. Of course, any number of squares may be used.

Figure 2:
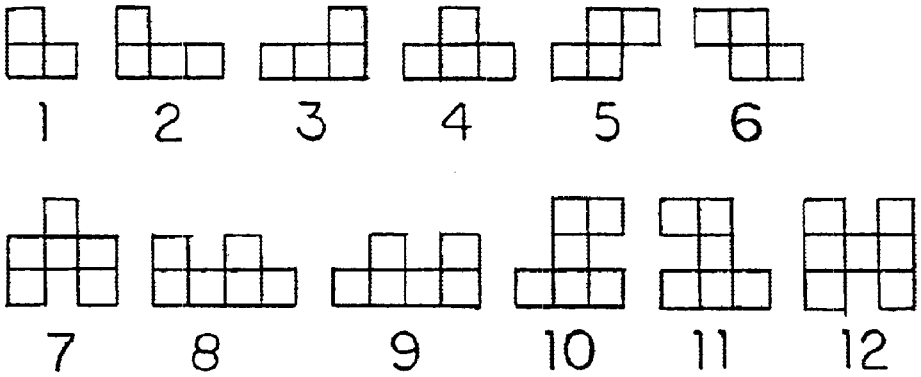
FIG. 2 shows individual pieces for the puzzle of the present invention.
Figure 3:
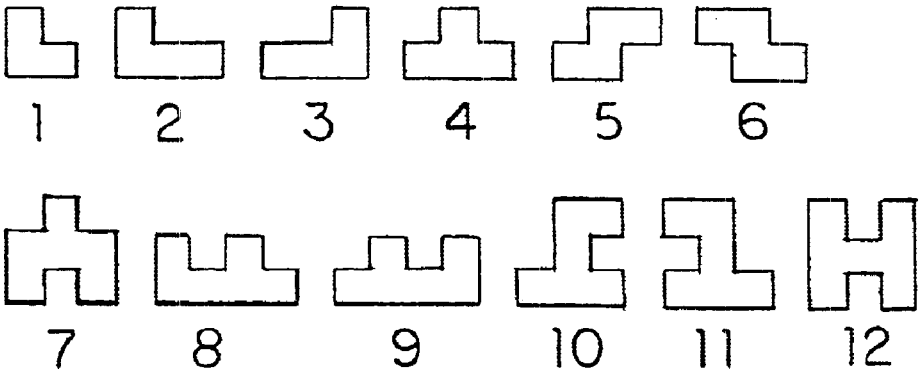
FIG. 3 depicts each puzzle piece by numbers.

The different puzzle pieces, comprising a plurality of relatively thin geometrical puzzle pieces designed to fit into an assembled tray, are shown in FIGS. 2 and 3. The puzzle pieces may embody a variety of shapes, so long as each shape is defined only by right angles (i.e., no acute or obtuse angles or curvatures). As shown in FIG. 2, each piece is made of a certain number of squares. FIG. 3 shows each piece without showing the squares. Each piece may be made of a different color.

FIGS. 2 and 3 provide non-limiting examples of the shapes that may comprise the puzzle pieces:

Carat or arrowhead shape;

upper case "L" shape;

mirror image of upper case "L" shape;

inverted upper case "T" shape, with all legs approximately equal;

mirror image of upper case "Z" shape;

upper case "Z" shape;

inverted tuning fork shape;

upper case "F" shape rotated clockwise 270 degrees;

mirror image of upper case "F" shape rotated clockwise 270 degrees;

lowercase "h" rotated clockwise 90 degrees;

mirror image of lowercase "h" rotated clockwise 90 degrees; and upper case "H" shape.

For purposes of illustration only, the pieces shown in FIG. 3 can be colored as follows:

| Pieces | Color |
|---|---|
| Numbers 1 and 7 | red |
| Numbers 2 and 8 | blue |
| Numbers 3 and 9 | green |
| Numbers 4 and 10 | orange |
| Numbers 5 and 11 | purple |
| Numbers 5 and 12 | light green |

Of course, one can make the pieces in any desired combination of colors. Alternatively, the pieces can be provided with decorative patterns in a variety of colors, or of patterns in black and white. The pieces are made different from each other in color or pattern so that they can be seen individually when the puzzle is completely assembled.

Figures 4, 5:
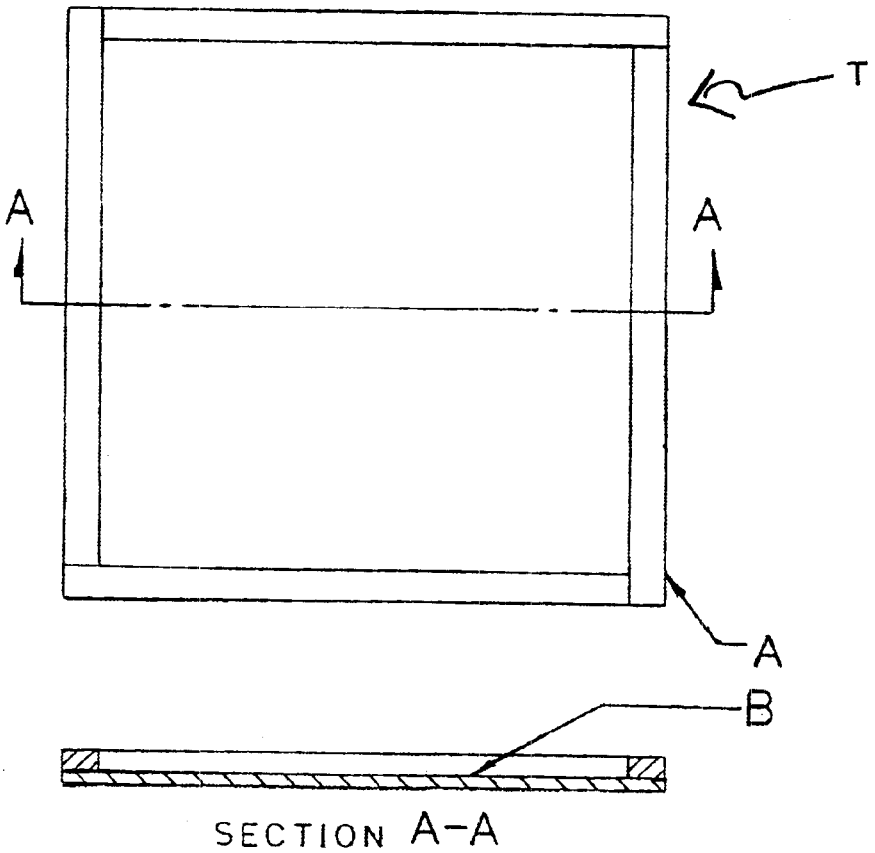
FIG. 4 is a chart giving the number of squares for each designed piece of the puzzle.
FIG. 5 illustrates a tray to hold the puzzle of the present invention.

The chart in FIG. 4 shows the number of squares for each designated piece of the puzzle. Column (A) is the number of each piece, column (B) is the number of pieces in the puzzle;

column (C) is the number of squares in each piece of the puzzle. Column (D) is the total number of squares which can be filled by those pieces of the puzzle. In this embodiment, there are a total of 31 pieces of the puzzle. At the bottom of the chart in FIG. 4 is the total number of all of the squares of the entire puzzle. However, one skilled in the art can design other combinations of pieces that require fewer or more pieces to complete the puzzle. Alternatively, the total number of squares may be greater or lesser.

FIG. 5 shows a tray T which is used to assemble the puzzle. Since the pieces are not interlocking, the tray is used to keep the puzzle pieces together during assembly. The tray comprises four rails A fastened onto a flat surface B. The flat surface B is used as a backing for the tray.

Figure 6:
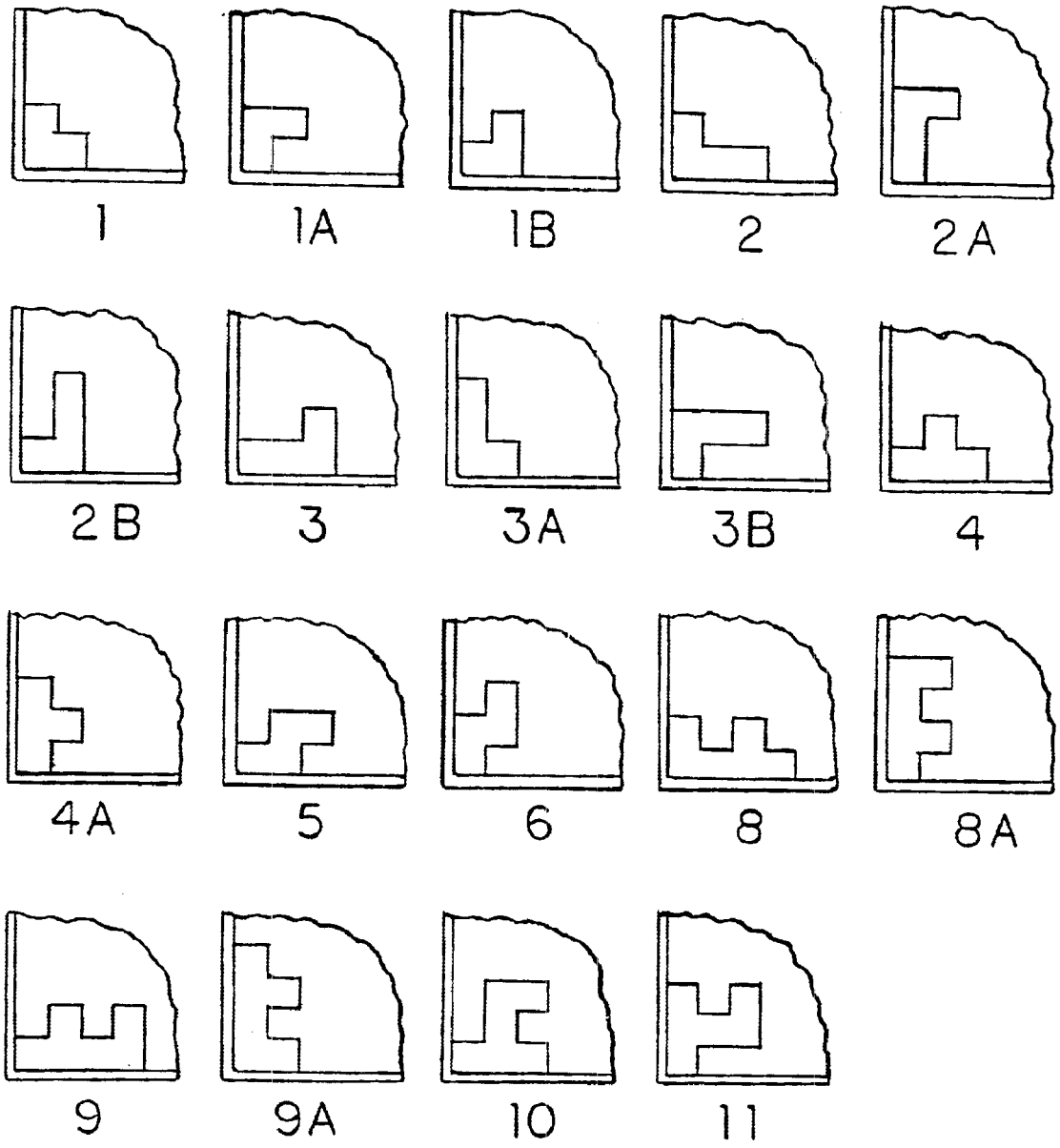
FIG. 6 shows initial starts for the numbered pieces.

FIG. 6 illustrates 19 possible starts for the puzzle. To begin the puzzle, a piece is placed in the left bottom corner of the puzzle square, From FIG. 6 it can be seen that piece 1 can be used in three positions, 1, 1A, and 1B. Piece 2 can be used in three positions, namely, 2, 2A, and 2B. Likewise, piece 3 can be used in three positions, 3, 3A and 3B. Piece 4 can only be used in two positions, 4 and 4A. Pieces 5 and 6 can only be used in one position to begin the puzzle. Piece 8 can be used in one of two positions: 8 and 8A. Piece 9 can begin the puzzle as shown in 9 and 9A. Pieces 10 and 11 each only have one beginning conformation.

Pieces 7 and 12 cannot be used to begin the puzzle.

Figure 7:
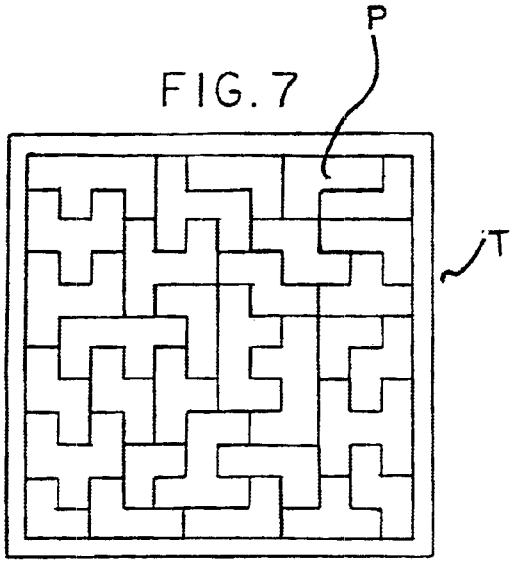
FIG. 7 shows a completed puzzle in the tray.

FIG. 7 shows a complete puzzle P assembled in the tray T.

Figure 8:
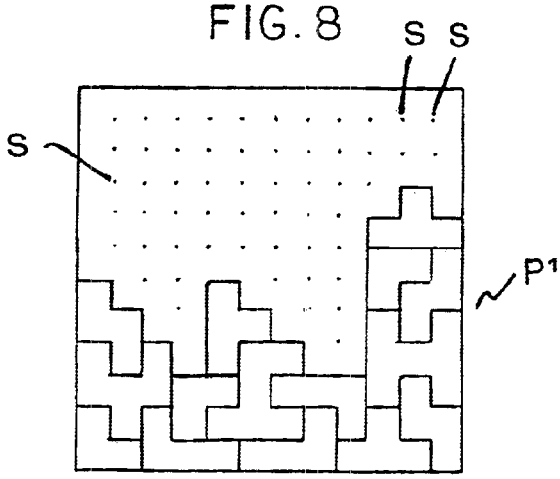
FIG. 8 shows a partially assembled puzzle in as square.

FIG. 8 shows a partially assembled puzzle P' in a square. The dots S illustrate where the division lines intersect. When this puzzle is assembled it will look like the puzzle shown in FIG. 7 and no division lines or intersections will be visible.

Figure 9:
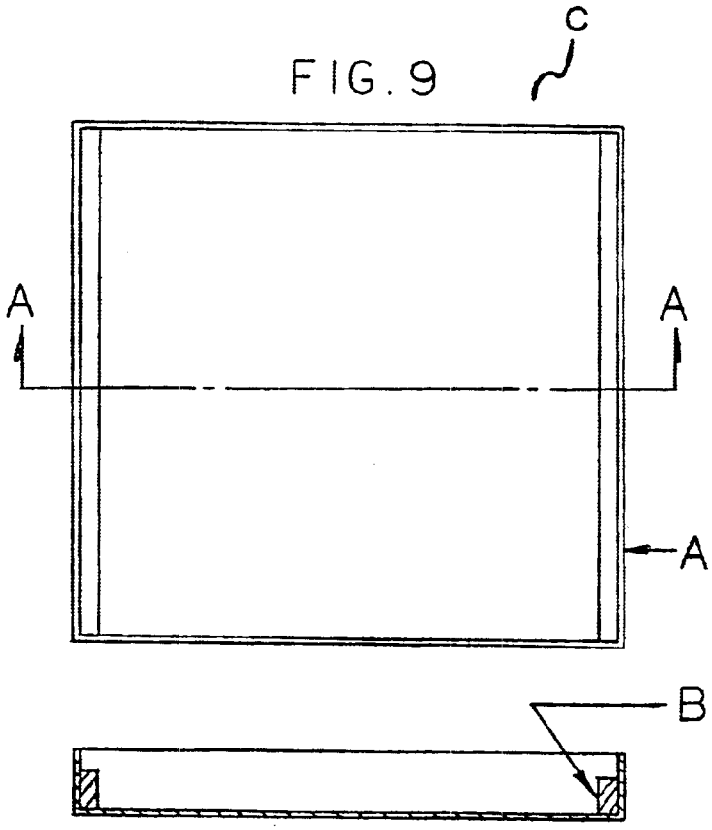
FIG. 9 shows the top view and a section A—A of the puzzle bottom container.

FIG. 9 shows a top view and a section A—A of the puzzle container C. Two rails B are located at two sides of the container to support the assembled tray shown in FIG. 5.

Figure 10:
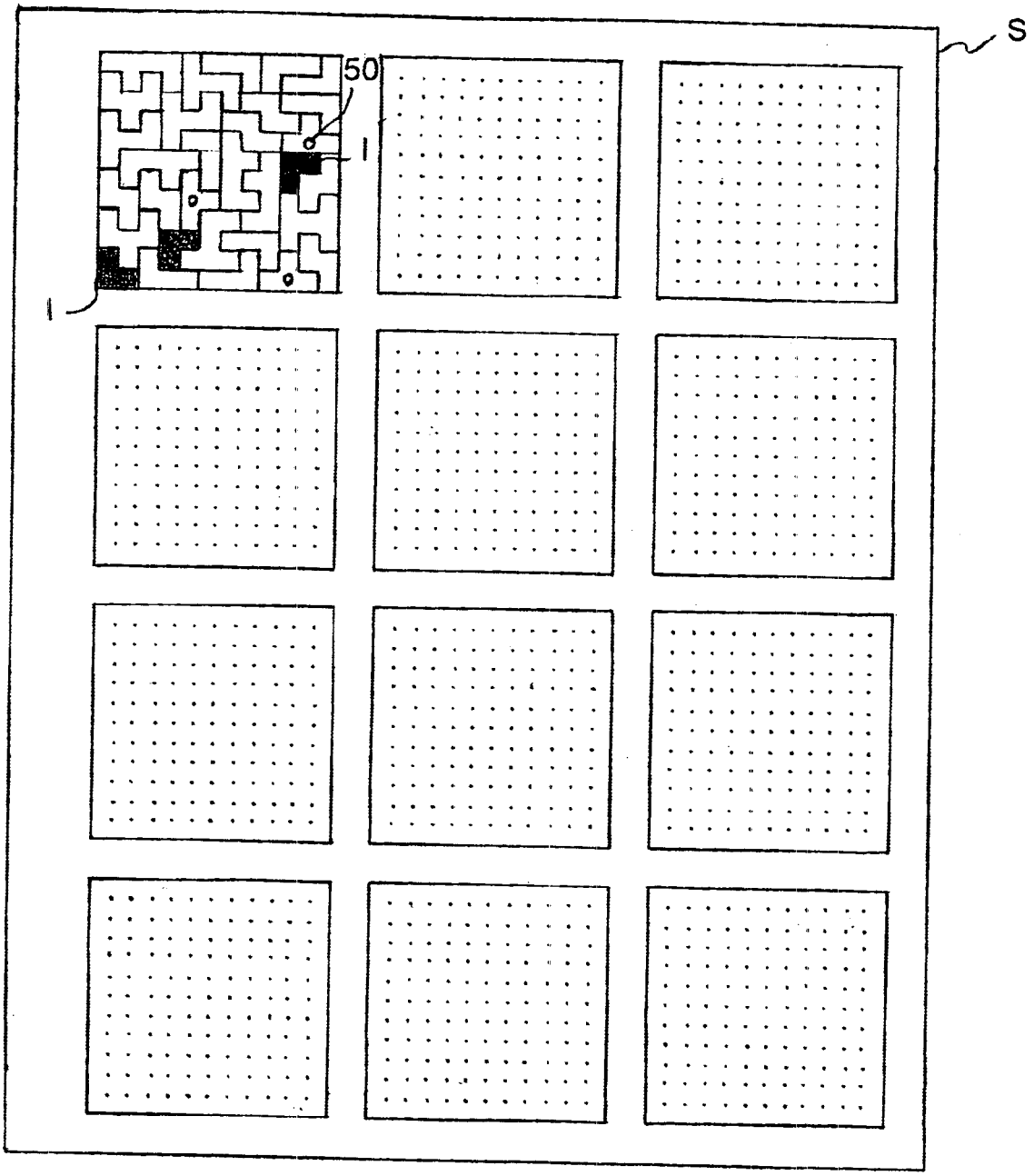
FIG. 10 shows one of 20 record sheets furnished with the puzzle.

FIG. 10 shows one of 20 record sheets S furnished with the puzzle. Each sheet records 24 finished assemblies. It is important not to mix different starts on a sheet. To begin recording the assembly, one shades the initial start where it appears in the puzzle I. Additionally, one draws a circle or other designation on piece 4 (50) puzzle pieces. One piece number 4 (three pieces) is marked with a small black circle for a special purpose. Mark this part when recording a finished puzzle. This gives a quick check for puzzle duplication. If the shaded initial puzzle piece and puzzle piece number 4 (50) with the circle or other designation drawn thereon and all other puzzle pieces are the same, there is a duplication of another assembly. If all other puzzle pieces do not match, then one has completed a different assembly.

Figure 11:
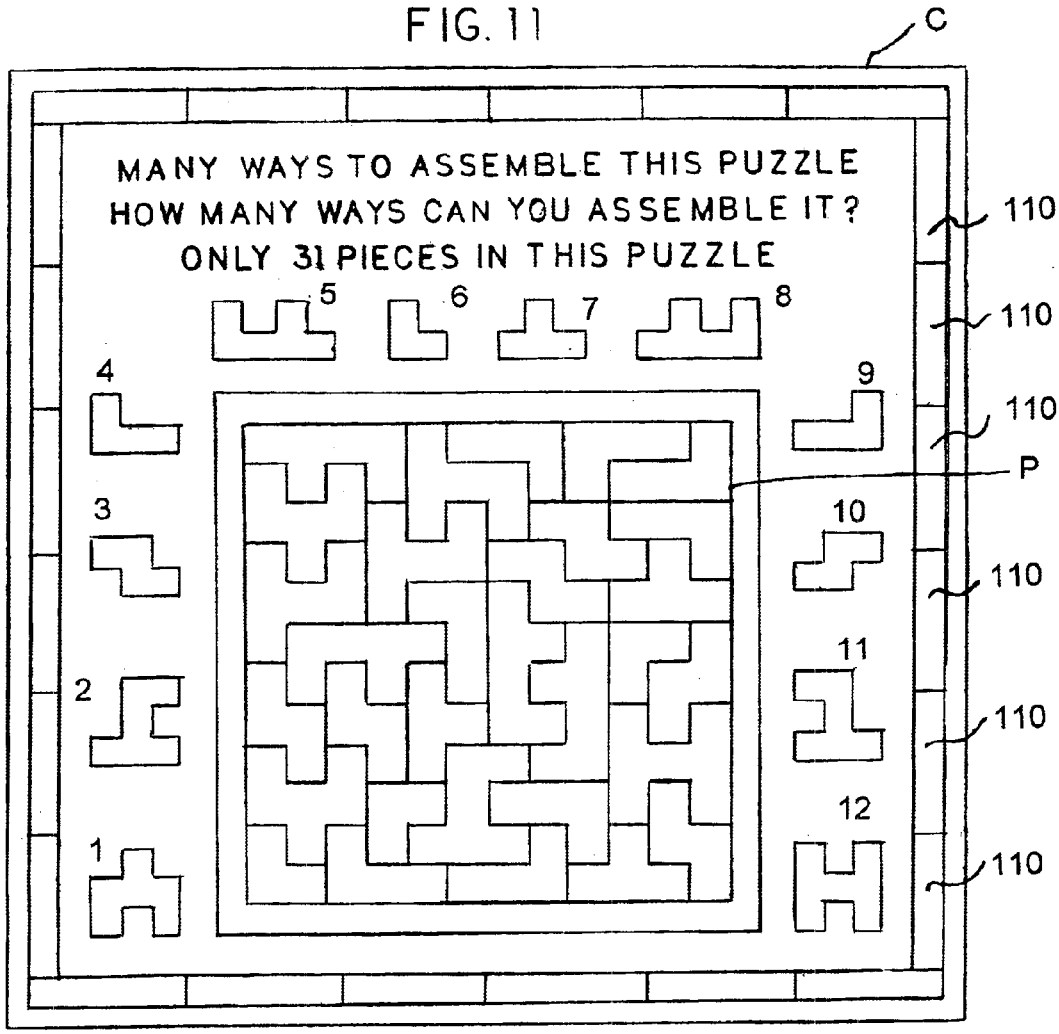
FIG. 11 shows the top view of the puzzle container.

FIG. 11 shows a top view of the puzzle container C which holds a puzzle P as shown in FIG. 7. Each side of the outside border of the puzzle is divided into six sections 110. In one embodiment of the invention, the outside border is divided into six sections, having different colors, e.g., red, blue, green, orange, purple and light green.

To begin the puzzle, a player places the initial piece as described above in the lower left hand corner of the tray to start. Subsequent pieces are added to cover the entire square. In one embodiment, piece number 1, serves as a starting piece for the puzzle, so that one piece is placed onto the tray prior to the other playing pieces. They may be placed in any one of a variety of locations as shown in FIG. 10, in which the starting pieces 50 are marked with a circle. There are at least 19 starting configurations, all of which are shown in FIG. 6.

Once the user places the initial pieces onto the assembly tray, he or she may add and incorporate any of the remaining pieces in any order or configuration believed will lead to a viable solution.

The puzzle pieces may be of uniform color or the color may be varied according to the shape of each piece. Alternatively, each piece may be patterned or surfaced differently from other pieces. By using more than one color or texture, the different solutions to the puzzle result in a plurality of interesting and attractive designs. As noted above, the starting pieces are marked with a circle or other indicator to indicate their special function.

The component pieces and tray of the puzzle of the present invention can be manufactured of any suitable materials. These include but are not limited to cardboard, acrylic, plastic, rubber, metal, wood, and combinations thereof.

The foregoing description of the specific embodiments will so fully reveal the general nature of the invention that other can, by applying current knowledge, readily modify and/or adapt for various application such specific embodiments without undue experimentation and without departing from the generic concept. Therefore, such adaptations and modifications should and are intended to be comprehended within the meaning and range of equivalents of the disclosed embodiments.

It is to be understood that the phraseology or terminology employed herein is for the purpose of description and not of limitation. The means and materials for carrying out various disclosed functions may take a variety of alternative forms without departing from the invention.

Thus, the expressions "means to . . . " and "means for . . . " as may be found in the specification above and/or in the claims below, followed by a functional statement, are intended to define and cover whatever structural, physical, chemical, or electrical element or structures which may now or in the future exist for carrying out the recited function, whether or nor precisely equivalent to the embodiment or embodiments disclosed in the specification above. It is intended that such expressions be given their broadest interpretation.

What is claimed is:

1. A puzzle which has multiple solutions forming multiple geometric patterns comprising:

a. a quadrilateral tray in which puzzle pieces are assembled;

b. a plurality of geometrical puzzle pieces which are assembled in said tray, wherein the shape of each puzzle piece is defined by right angles;

c. wherein at least one puzzle piece is an initial piece;

d. wherein a plurality of sheets, with 24 specially designed squares to each sheet are provided to record each finished puzzle.

2. The puzzle according to claim 1 wherein the puzzle shapes are selected from the group consisting of inverted tuning fork shape, lower case h rotated counterclockwise 90 degrees, uppercase L shape rotate 90 degrees, carat shape rotated 45 degrees, upper case T with all legs approximately equal, upper case F shape rotated clockwise 90 degrees, mirror image of upper case L shape rotated clockwise 90 degrees, mirror image of lowercase h shape rotated counterclockwise 90 degrees, and upper case h shape.

3. The puzzle according to claim 2 wherein the initial piece for assembling the puzzle is an upper case T shape.

4. The puzzle according to claim 1 wherein the initial puzzle pieces are designated with distinctive markings.

5. The puzzle according to claim 4 wherein the initial pieces are marked with a circle.

6. The puzzle according to claim 1 wherein the puzzle pieces are of uniform color.

7. The puzzle according to claim 1 wherein the puzzle pieces are of more than one color.

8. The puzzle according to claim 1 wherein the tray includes a storage space.

9. The puzzle according to claim 1 wherein there are 31 puzzle pieces.

10. The puzzle according to claim 1 wherein the tray is a square.

* * * * *